United States Patent [19]

Tanabe et al.

[11] Patent Number: 4,458,361

[45] Date of Patent: Jul. 3, 1984

[54] AM STEREO BROADCASTING SYSTEM

[75] Inventors: Kenzo Tanabe, Katano; Toshikazu Nezu, Neyagawa, both of Japan

[73] Assignee: Matsushita Electric Industrial Co., Ltd., Osaka, Japan

[21] Appl. No.: 377,248

[22] Filed: May 11, 1982

[30] Foreign Application Priority Data

May 15, 1981 [JP] Japan ..... 56-73720

[51] Int. Cl.[3] ..... H04H 5/00

[52] U.S. Cl. ..... 381/15; 381/16

[58] Field of Search ..... 381/15, 16

[56] References Cited

U.S. PATENT DOCUMENTS 4,194,088 3/1980 Streeter ..... 381/16

4,332,978 1/1982 Streeter ..... 381/16

*Primary Examiner*—R. J. Hickey

*Attorney, Agent, or Firm*—Wenderoth, Lind & Ponack

[57] ABSTRACT

An AM stereo broadcasting system for transmitting stereo signals in the AM broadcasting band. The system is based on amplitude modulation by two carriers having the same frequency and a 90° phase difference from each other, and is capable of increasing the modulation depth of pilot signals (used for stereo signal identification) irrespective of the stereo signals, so that the pilot signals can be easily detected. By modulating both the sum and difference signals by the pilot signal, the receiver portion of the present system can derive the pilot signal irrespective of the stereo signals, thereby obviating many of the previous AM stereo broadcasting system problems.

6 Claims, 6 Drawing Figures

AM STEREO BROADCASTING SYSTEM

BACKGROUND OF THE INVENTION

This invention relates to an AM broadcasting system used to transmit stereo signals in the AM broadcasting band.

In the past, the Harris Corp. presented an example of an AM stereo broadcasting system using two carriers having the same frequency and a 90-degree phase difference from each other. The details of this system are described in "A Linear AM Stereo System Using Quadrature Modulation" by Clifford Leitch and David L. Hershberger (IEEE Transactions of Broadcasting, Vol. BC-24, No. 3, September 1978). In the system proposed by the Harris Corp., a pilot signal for stereo signal identification is represented by a subsonic tone which is added to the (L−R) signal, as is obvious in FIG. 2 on page 61 of the above-mentioned article. The demodulation is carried out by the synchronous detection of the (L−R) signal, as illustrated in FIG. 3 on the same page of the article. In such a method, in order to modulate (L−R) signal sufficiently, the modulation depth of the pilot signals must be minimized; devices including filters must be incorporated in the circuit used for the pilot signal detection; and an insufficient modulation depth for the pilot signal, when the carrier-noise ratio is small, makes it difficult to distinguish the pilot signal from noise.

To solve these problems, this invention proposes an AM stereo broadcasting system which is capable of increasing the modulation depth of pilot signals irrespective of the stereo signals.

SUMMARY OF THE INVENTION

An object of this invention, which is based on the amplitude modulation by two carriers having the same frequency and a 90-degree phase difference from each other, is to offer an AM broadcasting system which facilitates the detection of pilot signals used for stereo signal identification.

BRIEF DESCRIPTION OF THE DRAWINGS

The details shall be described in the following paragraphs, with the help of the accompanying drawings in which:

FIGS. 1 and 1A are block diagrams of two embodiments of a transmitter according to the present invention;

DESCRIPTION OF THE PREFERRED EMBODIMENTS

Figure 1:
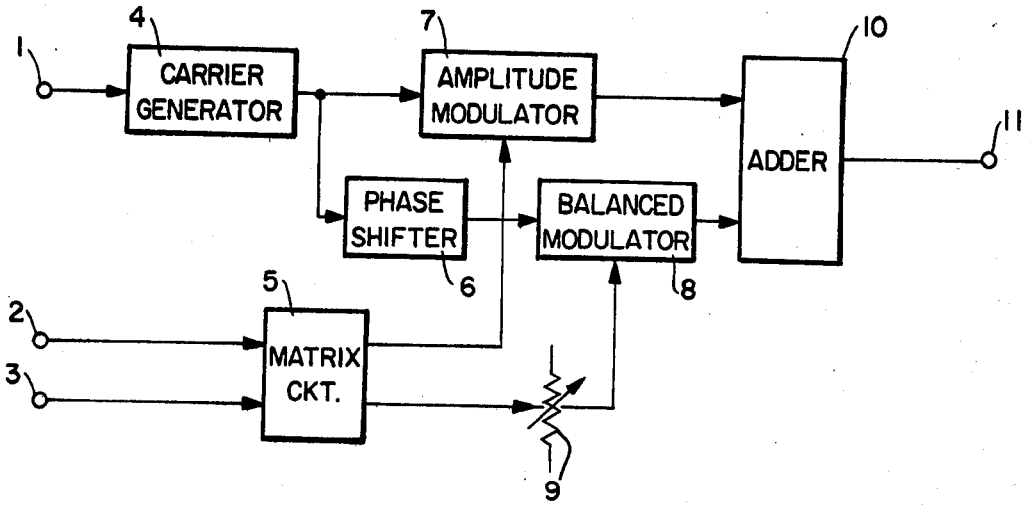

FIG. 1 shows a block diagram of an embodiment of a transmitter according to the present invention. In FIG. 1, a sinusoidal pilot signal having a frequency which is lower than the audible frequency band of audio frequency signals is fed to an input terminal 1 and the frequency modulation is carried out by the pilot signal in a carrier generator 4. The modulated carrier which has undergone frequency modulation by this pilot signal is fed to an amplitude modulator 7 and a $\pi/2$ radian phase shifter 6. The modulated carrier whose phase has been shifted by $\pi/2$ radians in the phase shifter 6 is then fed to a balanced modulator 8.

If the angular frequency of the pilot signal is represented by $w_p$(rad/sec), and the angular frequency of the carrier generated by the carrier generator 4 is represented by $w_c$(rad/sec), and if the modulation index of the frequency modulated carrier is represented by k, then the output of said carrier generator 4, or, the modulated carrier, can be expressed as follows:

$$v_1(t)=\sin(w_c t+k\sin w_p t) \tag{1}$$

The output of said phase shifter 6, or the modulated carrier whose phase has been shifted by $\pi/2$ radians, can be expressed as follows, based on the expression (1).

$$v_2(t)=\cos(w_c t+k\sin w_p t) \tag{2}$$

Left (L) and right (R) stereo signals are respectively fed to input terminals 2 and 3 and by way of a matrix circuit 5, an (L+R) signal And an (L−R) signal are produced. The (L+R) signal is fed to said amplitude modulator 7, and the (L−R) signal is fed to said balanced modulator 8 via an attenuator 9 having an attenuation l.

If the modulation indices of the modulators 7 and 8 are both m, then the output signals of the amplitude modulator 7 and the balanced modulator 8 can be expressed as follows: The output signal of the amplitude modulator 7 is as follows:

$$v_3(t)=\{1+m(L+R)\}\sin(w_c t+k\sin w_p t) \tag{3}$$

The output signal of the balanced modulator 8 is as follows:

$$v_4(t)=ml(L-R)\cos(w_c t+k\sin w_p t) \tag{4}$$

These output signals, represented by the expressions (3) and (4), are fed to an adder 10, whose output is provided at an output terminal 11.

Accordingly, the signal obtained at the output terminal 11 can be expressed as:

$$v_5(t)=A(t)\sin\{w_c t+\psi(t)\} \tag{5}$$

$$A(t)=\sqrt{\{1+m(L+R)\}^2+\{lm(L-R)\}^2} \tag{6}$$

$$\psi(t)=k\sin w_p t+\tan^{-1}\frac{lm(L-R)}{1+m(L+R)} \tag{7}$$

The expression (5) corresponds to the modulated signal of this invention.

As is obvious from the above-mentioned expressions (5), (6), and (7), when the modulated carrier obtained from the output terminal 11 is made to pass through an envelope detector, substantial distortion is caused. To mitigate this distortion, the attenuator 9 is incorporated, and its effect can be verified by the fact that when l is reduced, A(t) approximates $\{1+m(L+R)\}$.

On the other hand, stereo information is contained in the second term of the expression (7), or $$\tan^{-1}\frac{lm(L-R)}{1+m(L+R)}.$$

Therefore, when l is reduced, this second term is also reduced, resulting in the deterioration of the S/N at the time of stereo demodulation. This means that, in order to solve the two contradictory problems, namely "distortion" and "S/N deterioration at the time of stereo demodulation," a certain compromise is required for the attenuation l of the attenuator 9. In general, the value of l should be 0.2–0.5.

Figure 2:
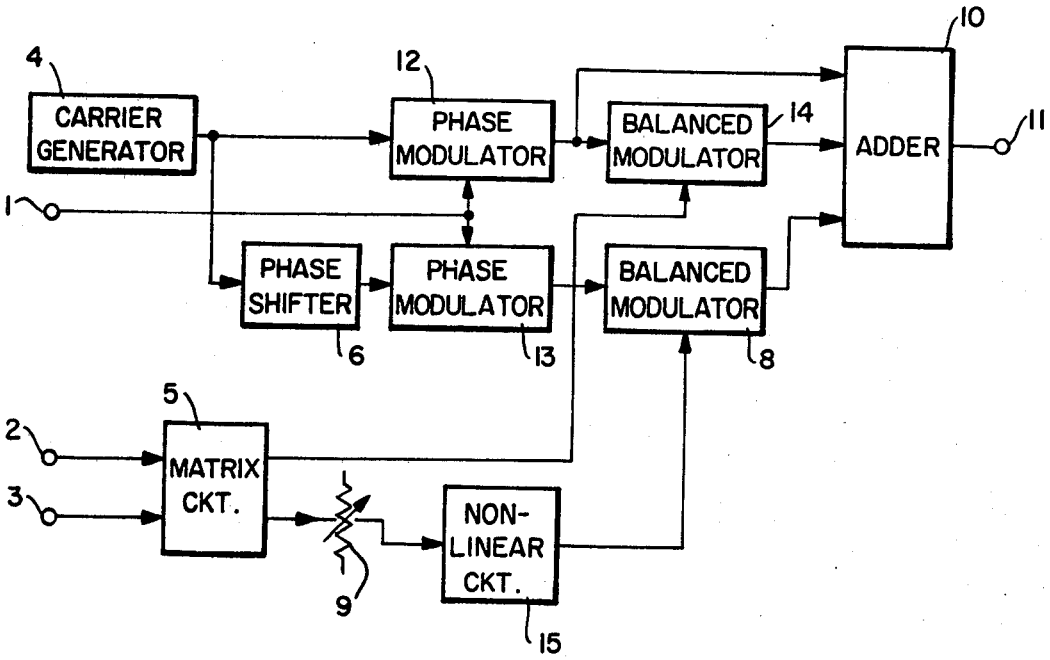
FIG. 2 is a block diagram of another embodiment of a transmitter according to the present invention.

FIG. 2 shows another embodiment used to obtain a modulated signal of this invention. A non-linear circuit used for instantaneous compression is incorporated into the (L−R) signal in order to solve the above-mentioned two problems with some improvements. In the following paragraphs, description will be given in relation to FIG. 2.

In FIG. 2, the block or terminal numbered in the same way as in FIG. 1 has the same function as in FIG. 1. Details of such blocks or terminals shall be omitted here. In FIG. 2, the output signals of the carrier generator 4 are fed to a phase modulator 12, and to a phase modulator 13 through the $\pi/2$ radian phase shifter 6. To said phase modulators 12 and 13, pilot signals are fed via the input terminal 1. Therefore, the output signals of the phase modulators 12 and 13 can be respectively expressed by the abovementioned expressions (1) and (2). The output signals of these phase modulators 12 and 13 are respectively fed to balanced modulators 14 and 8 together with the (L+R) signal obtained from the matrix circuit 5 and an l(L−R)* signal obtained from a non-linear circuit 15 used for instantaneous compression. The balanced modulator 14 has exactly the same function as that of the balanced modulator 8.

The non-linear circuit 15 is provided for the instantaneous compression of the signal amplitude. It can be formed, for example, by utilizing the logarithmic characteristic of the voltage-current characteristics of a semiconductor PN junction diode. The output of the non-linear circuit 15 is marked * for the indication that the signal l(L−R) has undergone instantaneous amplitude compression.

An output signal of the phase modulator 12, or sin ($w_c t + k \sin w_p t$), and an output signal of the balanced modulator 14, or m(L+R) sin ($w_c t + k \sin w_p t$), and an output signal of the balanced modulator 8, or lm(L−R)* are fed to the adder 10 in FIG. 2. The modulated signal obtained from the output terminal 11 is the same as the one represented by the abovementioned expression (5). However, the expressions (6) and (7) must be changed into the following expressions, respectively.

$$A'(t) = \sqrt{\{1+m(L+R)\}^2 + \{lm(L-R)^*\}^2} \quad (6)'$$

$$\psi'(t) = k \sin w_p t + \tan^{-1}\frac{lm(L-R)^*}{1+m(L+R)} \quad (7)'$$

The non-linear circuit 15 used for instantaneous compression is incorporated so that it carries out the same function as that of a compander used in telephone systems, in collaboration with non-linear circuit used for instantaneous expansion. The circuit is effective in mitigating the S/N deterioration at the time of stereo demodulation.

Figure 3:
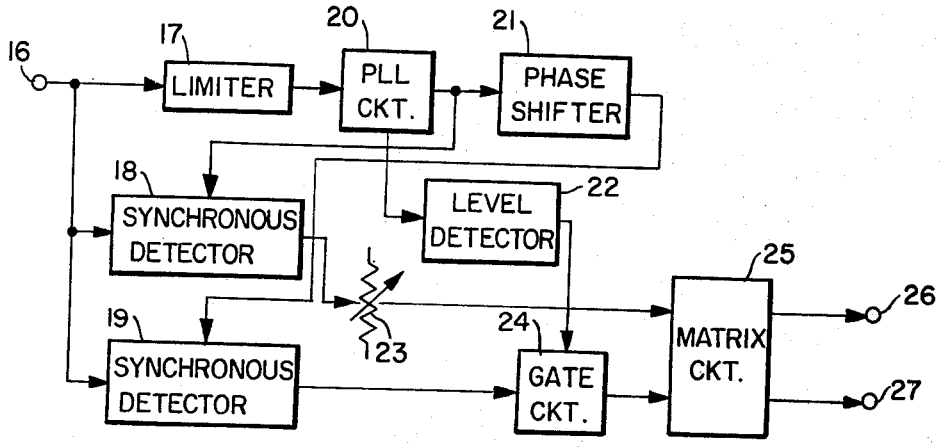
FIG. 3 is a block diagram of an embodiment of a receiver according to the present invention.

FIG. 1A illustrates an embodiment of the present invention which is identical to that illustrated in FIG. 1 after being modified by the addition of the non-linear circuit 15 described with respect to FIG. 2. The detailed description of FIG. 1A has been omitted since its operation can easily be discerned by referring to the descriptions of the operation of FIGS. 1 and 2 noted above. FIG. 3 shows a block diagram of an embodiment of a receiver according to this invention used for the demodulation of the modulated carrier. The modulated carriers shown in the above-mentioned expressions (5), (6), and (7) are respectively fed to a limiter 17, and synchronous detectors 18 and 19, after frequency conversion and other processes, as the case may be. The limiter 17 is designed so as to eliminate the amplitude modulated component contained in the input signal as shown in the expression (6). The output signal obtained from the limiter 17 is fed to a PLL (phase locked loop) circuit 20, where the carrier which is only modulated by the pilot signal is extracted. The capability of the PLL circuit 20 to extract such a carrier shall be explained in the following paragraphs with reference to FIG. 4.

Figure 4:
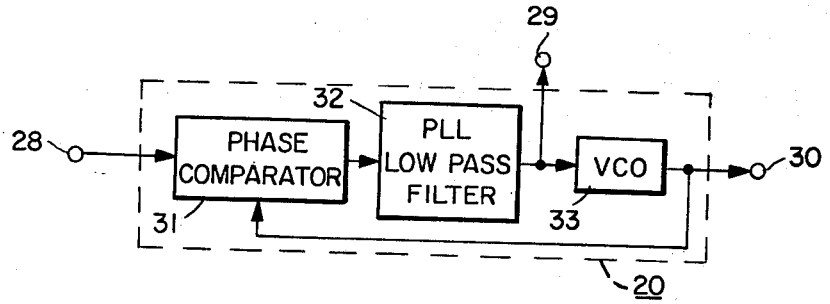
FIG 4 is a block diagram of an embodiment of a PLL circuit used in the present invention.

In FIG. 4, the output signal of the limiter 17 which is obtained via a terminal 28 is fed into the phase comparator. To a phase comparator 31, the oscillation signal obtained from a voltage controlled oscillator 33 (hereinafter "VCO") is fed at the same time. A voltge corresponding to the phase difference between these signals is applied to PLL low pass filter 32 which controls the response of the PLL circuit. The output signal of the PLL low pass filter 32 is not only fed to an output terminal 29 but is also used as the conrol input signal for the VCO 33.

If the sensitivity of the phase comparator 31 is represented by $K_1$[V/rad], and the transfer function of the PLL low pass filter 32 is represented by F(s) after a Laplace transformation, and the control sensitivity of the VCO 33 is represented by $K_2$[Hz/v], then the loop gain of the PLL circuit after a Laplace transformation is:

$$\frac{K_1 \cdot K_2 \cdot F(s)}{S} \text{ [Hz/rad].}$$

If a phase modulated component of the output of the limiter 17 which is fed into the input terminal 28 is represented by ψi(s), and that of the output signal of the VCO 33 obtained from an output terminal 30 is represented by ψo(s), then the relationship between the above-mentioned ψi(s) and ψo(s) can be expressed as follows after a Laplace transformation.

$$\frac{\psi o(s)}{\psi i(s)} = \frac{\dfrac{K_1 \cdot K_2 \cdot F(s)}{S}}{1+\dfrac{K_1 \cdot K_2 \cdot F(s)}{S}} \quad (8)$$

Since loop gain $$\frac{K_1 \cdot K_2 \cdot F(s)}{S}$$

as shown in the expression (8) is generally designed to possess an integration characteristic, the input phase modulated component and the output phase modulated component become almost equal to each other in the low frequency band where loop gain is much larger than 1, as is obvious from the expression (8). On the other hand, the output phase modulated component becomes much smaller than the input phase modulated component in the high frequency band where the loop gain is less than 1.

Assuming that a pilot signal of 5 Hz, which is lower than the audio frequency, is selected, for example, and assuming that the above-mentioned loop gain is designed to become equal to 1 at a frequency of 20 Hz, then the input phase modulated component of said PLL circuit 20 and the output phase modulated component will be almost equal at the pilot frequency, and in the audio frequency range of over 200 Hz, said output phase modulated component becomes very small, indicating that the output signal of the PLL circuit 20 can be substantially regarded as a signal which has undergone angular modulation by the pilot signal. In other words, the PLL circuit 20 can be regarded as the carrier extraction circuit for extraction of a carrier which as been modulated by pilot signal, and its output signal can be represented by the above-mentioned expression (1). For the output signal of the PLL circuit 20 to be expressed by the expression (1), it goes without saying that a means to apply a DC correcting voltage to the VCO of the PLL circuit or the incorporation of a phase shift circuit subsequent to the PLL circuit 20 is required.

Turning back to FIG. 3, the output signal obtained from the VCO of the PLL circuit is fed to the synchronous detector 18 and is simultaneously fed to the $\pi/2$ radian phase shifter 21, whose output is fed in turn to the synchronous detector 19. The output signal of the phase shifter 21 can be represented by the above-mentioned expression (2). Accordingly, an output in proportion to the m(L+R) signal can be obtained on the output side of the synchronous detector 18, and an output in proportion to the lm(L−R) signal can be obtained on the output side of the synchronous detector 19. The output signal of the synchronous detector 18 is fed to a matrix circuit 25, via an attenuator 23 having the same attenuation 1 as that of the attenuator 9. The output signal of the synchronous detector 19 is fed to the matrix circuit 25, via a gate circuit 24. The enabling and disabling of said gate circuit 24 is controlled by a low frequency level detector 22, depending on the presence or absence of the pilot signal at the other output terminal of the PLL circuit, that is, terminal 29 in FIG. 4. The output terminal 29 of the PLL circuit 20 is regarded as a frequency demodulated signal output terminal in the frequency range where the loop gain of the PLL circuit is much large than 1, and this terminal is used as the pilot signal detecting terminal.

Therefore, since the level of the input signals to the matrix circuit 25 is proportional to the lm(L+R) signal and the l(L−R) signal, when the pilot signal is obtained from the PLL circuit 20, the stereo demodulated L and R signals can be fed to the two output terminals 26 and 27 of the matrix circuit 25 by making the proportionality constants of these signals, or the sensitivities of the synchronous detectors 18 and 19 equal. The matrix circuit 25 has the same function as that of the matrix circuit 5 on the transmitter side. When an input signal to the receiving terminal is not a stereo signal having a pilot signal and when no pilot signal is output from the PLL circuit 20, then the gate 24 is closed, then the input signal to the matrix circuit 25 is only the signal which is proportional to the ml(L+R) signal and a signal which is proportional to the (L+R) signal is fed to both output terminals 26 and 27.

Figure 5:
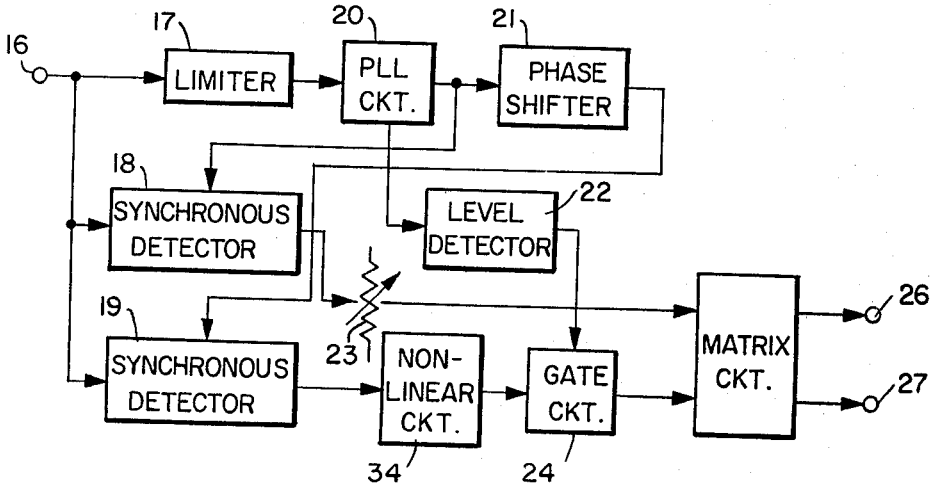
FIG. 5 is a block diagram of another embodiment of a receiver according to the present invention.

FIG. 5 shows a block diagram which illustrates a demodulation circuit in which a non-linear circuit 34 used for instantaneous expansion, and having characteristics that run counter to those of the non-linear circuit 15 used for instantaneous compression as described in FIG. 2, is incorporated. This non-linear circuit 34 for instantaneous expansion is intended to improve the demodulation S/N of the (L−R) signal system, in collaboration with the non-linear circuit 15 on the transmitter side, as described earlier. Like the non-linear circuit 15, the non-linear circuit 24 is formed by the utilization of the logarithmic characteristic of the voltage-current characteristics of a semiconductor PN junction diode, for example. The blocks having the same numbers in FIG. 4 and FIG. 5 have the same functions. This concludes the description of one example of the receiving terminal signal demodulation section which can be adapted to the AM stereo broadcasting system of this invention.

As has been described in detail, this invention permits the demodulation of a pilot signal with an excellent S/N because the modulation depth of the pilot signal can be increased irrespective of the (L−R) signal, and is also very practical in that the detection of the pilot signal at the receiving terminal can be facilitated. In addition, since orthogonal modulation is carried out for (L+R) and (L−R) signals, the occupied bandwidth does not increase in comparison with a monaural signal, which achieves compatibility with the existing monaural signal, which achieves compatibility with the existing monaural system. Furthermore, the instantaneous compression and expansion of the (L−R) signal system minimizes the increase in the distortion in a monaural receiver using an envelope detector, while improving the demodulation S/N of the (L−R) signal. Thus, this invention has practical advantages.

In order to simplify the description of the examples of use of this invention, no mention was given to filters fitted on the modulators, detectors, and limiters. However, consideration is naturally required for the use of these filters.

In the examples, the method to extract the carriers containing the pilot signal using the PLL circuit was described. However, it goes without saying that other kinds of narrow bandpass filters, for example, a filter using resonant element such as crystal element, can be employed. Although the modulation by the pilot signal is carried out before the two carriers are synthesized in the adder 10 in FIG. 1 and FIG. 2, it must be noted that the modulation after synthesis results in an equal effect.

What is claimed is:

1. An AM stereo broadcasting system for transmitting and receiving left and right stereo signals respectively denoted L and R, said system having a transmitter comprising:

a carrier signal generating means for generating a pair of carrier signals having the same frequency but differing in phase by 90°;

a sum-difference means for generating the sum and differences of said left and right stereo signals respectively denoted (L+R) and (L−R);

an amplitude modulator means operatively connected to said carrier signal generating means and said sum-difference means for amplitude modulating one of said pair of carrier signals by said (L+R) signal;

an attenuator means operatively connected to said sum-difference means for multiplying said (L−R) signal by a constant l, wherein l≦1 so as to generate a signal l(L−R);

a balanced modulator means operatively connected to said carrier signal generating means and said attenuator means for modulating a second of said pair of carrier signals by said l(L−R) signal;

an adder means operatively connected to said amplitude and balanced modulator means for adding outputs from said amplitude and balanced modulator means so as to thereby produce a transmitted signal;

wherein said carrier signal generating means further comprises a means for angle modulating said pair of carrier signals by a single sinusoidal signal with the same modulation index, said sinusoidal signal having a frequency which is lower than that of a frequency band of said L and R signals.

2. An AM stereo broadcasting system for transmitting and receiving left and right stereo signals respectively denoted L and R, said system having a transmitter comprising:

a carrier signal generating means for generating a pair of carrier signals having the same frequency but differing in phase by 90°;

a sum-difference means for generating the sum and differences of said left and right stereo signals respectively denoted (L+R) and (L−R);

an attenuator means operatively connected to said sum-difference means for multiplying said (L−R) signal by a constant l, wherein l≦1 so as to generate a signal l(L−R);

a balanced modulator means operatively connected to said carrier signal generating means and said attenuator means for modulating one of said pair of carrier signals by said l(L−R) signal;

another balanced modulator means operatively connected to said carrier signal generating means and said sum-difference means for modulating a second of said pair of carrier signals by said (L+R) signal;

an adder means operatively connected to said balanced modulator means and said another balanced modulator means and said carrier signal generator means for adding outputs thereof so as to produce a transmitted signal;

wherein said carrier signal generating means further comprises a means for angle modulating said pair of carrier signals by a single sinusoidal signal with the same modulation index, said sinusoidal signal having a frequency which is lower than that of a frequency band of said L and R signals.

3. An AM stereo broadcasting system as recited in claims 1 or 2, wherein said transmitter further comprises a non-linear circuit means operatively connected between said attenuator means and said balanced modulator means for instantaneously amplitude compressing said l(L−R) signal prior to its modulating said second of said pair of carriers.

4. An AM stereo broadcasting system for transmitting and receiving left and right stereo signals respectively denoted L and R, said system having a receiver comprising:

a receiving means for receiving a signal having a pair of carriers whose phases are mutually orthogonal and which have been angle modulated by a single sinusoidal signal with the same modulation index, said sinusoidal signal having a frequency which is lower than that of a frequency band of said L and R signals;

a phase locked loop circuit means operatively connected to said receiving means and a phase shift means operatively connected to said phase locked loop circuit means for extracting said pair of carriers and said sinusoidal signal from said received signal;

a pair of synchronous detector means both operatively connected to said receiving means and respectively operatively connected to said phase locked loop circuit means and said phase shift means for deriving sum and differences of said left and right stereo signals respectively denoted (L+R) and L−R);

an attenuator means operatively connected to one of said pair of synchronous detector means for multiplying said (L+R) signal by a constant l, wherein L≦1 so as to generate an output signal l(L+R);

a gate circuit means operatively connected to another of said pair of synchronous detector means and said phase locked loop circuit means for providing an output or inhibiting an output corresponding to said (L−R) signal in dependence upon said extracted sinusoidal signal;

a matrix means operatively connected to said attenuator means and said gate circuit means for deriving said L and R signals from said outputs from said attenuator means and said gate circuit means.

5. An AM stereo broadcasting system as recited in claim 4, wherein said receiver further comprises a non-linear circuit means operatively connected between one of said synchronous detector means and said gate circuit means for instantaneously expanding said (L−R) signal so as to thereby correct instantaneous compression characteristics effected on said (L−R) signal prior to its transmission.

6. An AM stereo broadcasting system as recited in claims 4 or 5, wherein said phase locked loop circuit comprises a phase comparator means whose output feeds a low pass filter means whose output feeds a voltage controlled oscillator means whose output is fed back to said phase comparator means such that when said received signal is compared in said phase comparator means with said output of said voltage controlled oscillator, said output of said voltage controlled oscillator means corresponds to one of said pair of carriers and said low pass filter means output corresponds to said sinusoidal signal.

* * * * *